United States Patent [19]

Dutton

[11] Patent Number: 4,768,245

[45] Date of Patent: Sep. 6, 1988

[54] PILLOW WITH BOOK IN POCKET

[75] Inventor: June K. Dutton, Sausalito, Calif.

[73] Assignee: Determined Productions, Inc., San Francisco, Calif.

[21] Appl. No.: 96,059

[22] Filed: Sep. 14, 1987

[51] Int. Cl.[4] ..... A47G 9/00

[52] U.S. Cl. ..... 5/434; 5/485; 5/490; D6/601

[58] Field of Search ..... 5/490, 434, 436, 485, 5/442, 482; D6/601

[56] References Cited

U.S. PATENT DOCUMENTS

| | | | |
|---|---|---|---|
| 1,587,387 | 6/1926 | Lichtman | 5/482 |
| 3,120,721 | 2/1964 | Bukatman et al. | 5/485 |
| 4,309,784 | 1/1982 | Cohen | 5/490 |

FOREIGN PATENT DOCUMENTS

| | | | |
|---|---|---|---|
| 16809 | of 1907 | United Kingdom | 5/490 |

*Primary Examiner*—Alexander Grosz
*Attorney, Agent, or Firm*—Thomas M. Freiburger

[57] ABSTRACT

A children's pillow and book combination includes a pillow of conventional construction with a pocket for receiving a book. The cover of the book contains some indicia, design or color representing the content or subject matter of the book or simply identifying the book. The pillow is keyed to the book, bearing some indicia of the content or subject matter of the book or colors or a design present on the book cover, so that a child may associate the pillow with the book.

11 Claims, 1 Drawing Sheet

PILLOW WITH BOOK IN POCKET

BACKGROUND OF THE INVENTION

The invention relates to pillows, and more specifically to a children's pillow and book combination wherein the pillow and the book share a common theme.

Several forms of pillows with pockets or storage compartments have been known. U.S. Pat. No. 4,389,784 to Cohen is directed to a pillow/display case for displaying various small objects. The pillow/display case in Cohen has a transparent flexible overlay sheet secured to a wall of the pillow, creating a display pocket for the objects. U.S. Pat. No. 4,091,481 to Redman discloses a tooth shaped pillow with a pocket for holding money and baby teeth. Mohr U.S. Pat. No. 3,863,283 shows a cushion particularly for carrying in an automobile, with a pocket for storing first aid material. U.S. Pat. No. 2,962,731 to Bounds discloses a pillow with an interior pocket for carrying a radio, a handkerchief or valuable articles.

The prior art also includes pillow combinations which combine a pillow with some other article. U.S. Pat. No. 4,227,270 to Rivera is directed to a pillow with a baby bottle holder. British Pat. No. 93,649 (Birch) discloses a hot water bottle in a pillow.

None of the prior pillow combinations discloses a children's pillow and book combination with the unique aspects, uses and advantages of the present invention described below.

SUMMARY OF THE INVENTION

Pursuant to the present invention, a pillow of conventional construction has a cover of flexible material, with stuffing held within the cover. The pillow is of appropriate size and shape to be used by a child. On one face of the pillow a pocket is secured to the pillow cover with an opening for receiving a children's book. The cover of the book is provided with a graphic design, title or other indicia which is related to the content or subject matter of the book. Similarly, on at least one side the pillow bears a graphic design or indicia coordinated with the book and related to the content of the book.

A broad object of the present invention is to provide a children's pillow and book combination wherein the pillow contains a pocket for receiving and storing the book. The pillow and book covers preferably both contain indicia related to the content or subject matter of the book so that a child may associate the pillow with the book. In any event, the pillow and either the book cover or the book contents are keyed together or related so that a young child can associate the book with the pillow.

A related object of the invention is to provide a children's pillow associated with the content of a children's book, so that the child has a stimulus for using the pillow while being read to from the book or while reading or reviewing the book, and so that the child learns to associate the pillow and book from outward indicia and to store the book in the proper pillow, even before the child learns to read.

These and other objects, advantages and features of the invention will be apparent from the following description of a preferred embodiment, considered along with the accompanying drawings.

DESCRIPTION OF PREFERRED EMBODIMENTS

Figure 1:
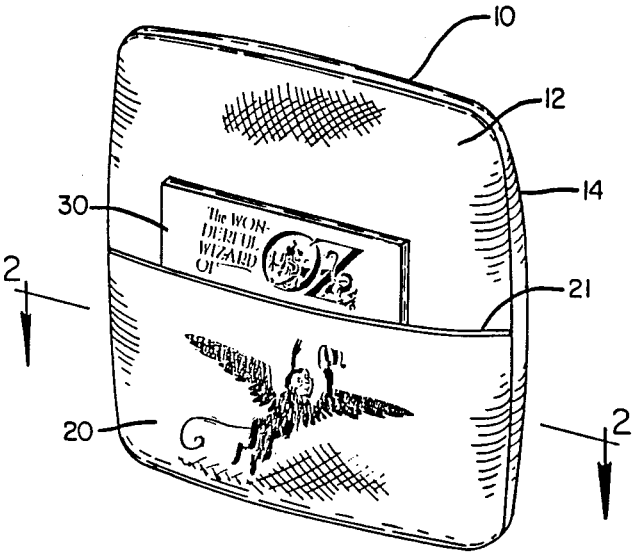
FIG. 1 is a perspective view showing a preferred embodiment of a pillow and book combination according to the present invention.
Figure 2:
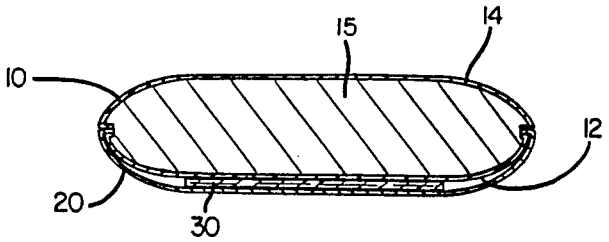
FIG. 2 is a sectional view taken along the line 2—2 of FIG. 1.

Referring to FIGS. 1 and 2, the present invention includes a pillow 10 which may be of conventional construction. The pillow 10 has a cover comprising two opposed walls 12 and 14 secured together along their periphery, although other pillow shapes and seam constructions may be used. Between the opposed walls is a space containing stuffing material 15. The pillow is of appropriate size and shape for use by a child, for cushioning the child's head or for hugging while the child sleeps or otherwise for providing comfort to the child.

On one face of the pillow is a pocket 20 which may be formed as shown or by other suitable constructions. In the illustrated embodiment a sheet of suitable flexible material 20 is secured to the outer surface of one of the walls of the pillow. The material used for the pocket may for example be the same type of material used for the cover of the pillow, and preferably is substantially opaque. At its top 21, the pocket is open for receiving a children's book 30. In this embodiment the pocket is secured to the pillow along three sides of the pocket sheet 20, with one side or end left unsecured to form an opening. While the pocket of this preferred embodiment is open, the pocket may also have closure means such as a zipper, snaps or Velcro hook and loop fastener for closing the pocket.

Figure 4:
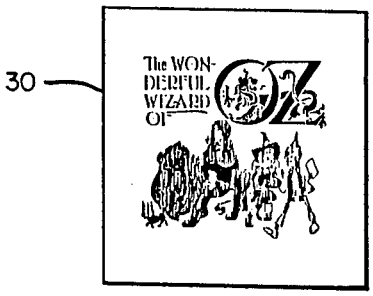
FIG. 4 shows an example of the cover of a book which fits in the pillow shown in FIGS. 1, 2 and 3.

The children's book 30 may be a children's story book, picture book, puzzle book or other type of children's book, preferably with a theme. The book cover is provided with some marking which is indicative of or related to the contents of the book, such as a title, a picture, and/or some other graphic design. As an example, the drawing shows a story book based on the story *The Wizard of Oz*, in which case the book cover may contain representations of characters or a scene described or shown in the book. FIG. 4 shows a book cover as in this example. In the illustrated embodiment, the book is of such height with respect to the pocket that it extends out of the pocket when fully inserted, thereby exposing a portion of the book cover—in this case approximately one-fourth to two-fifths of the book cover. As illustrated in FIG. 1 the exposed portion of the book may include its title.

As shown in the drawings, the pillow cover is also provided with some indicia on at least one of its outer surfaces. This may not be the same marking as on the book cover, but it too is related to the content or subject matter of the book or at least somehow keyed to the book so that a child may associate the pillow with the book cover or with the subject matter of the book. As with the book cover, the marking on the pillow may be a picture or graphic design with or without some wording.

Figure 3:
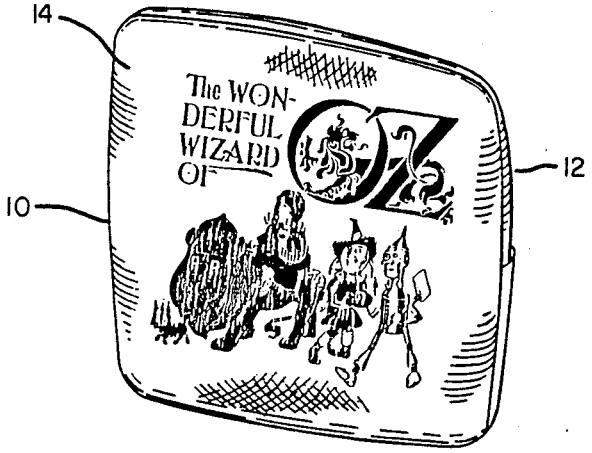
FIG. 3 is a perspective view showing the opposite side of the pillow shown in FIG. 1.

For example, as shown in the drawings, where the book is based on the story *The Wizard of Oz*, the design on the pillow may contain representations of characters or a scene described or shown in the book. The indicia on the pillow cover and the book cover may be substantially similar to further show the relation between the pillow and the book. As shown in FIG. 3, one surface of the pillow may include the title of the book. Also as shown in FIG. 3, a full design and title may be placed on the side of the pillow opposite the side containing the pocket. However, it should be understood that the indicia on the pillow cover may be located any place on the cover or the pocket and may also cover substantially the entire outer surface of the pillow if desired.

The book 30 may be a type of children's book other than a story book. It preferably has a common theme throughout (which is represented on its cover and on the pillow), but it may instead contain a series of pictures or puzzles or other children's activity pages which do not follow a common theme. Such a book can still form a part of the invention, so long as at least the cover of the book or the content of the book is keyed to designs or marking on the pillow. The pillow and book cover can be keyed together by color(s), words or design.

The above described preferred embodiments are intended to illustrate the principles of the invention, but not to limit the scope of the invention. Various other embodiments and modifications to these preferred embodiments may be made by those skilled in the art, without departing from scope of the following claims.

What is claimed is:

1. A children's pillow and story book combination comprising:

a pillow of appropriate size and shape to be used by a child, having two opposed walls, secured together around the periphery of the walls and with cushioning material between the walls, pocket means on the outside of one of the walls of the pillow, comprising a sheet of material secured to said one pillow wall around the periphery of the sheet of material except at one side so as to form an open pocket of suitable size and shape for receipt of a children's book, a children's book received in the pocket having textual material and a cover on the front of the book with indicia identifying the contents of the book, the book and the pocket being so sized and configured that the book extends part way out of the pocket when fully inserted therein, exposing some of the indicia on the front of the book which identifies the book, and the pillow having on at least one of its outer surfaces some printed material identifying the content of the book and representative of the book subject matter such that a child can associate the book with the pillow to the exclusion of other generally similar pillows.

2. The combination defined in claim 1, wherein the pillow printed material includes a picture which represent a story in the book.

3. The combination defined in claim 2, wherein the front of the book includes a picture generally similar to the picture on the pillow surface.

4. The combination defined in claim 1, wherein the printed material on the pillow is on a surface opposite the side of the pillow where the pocket is located.

5. The combination defined in claim 1, wherein both the exposed part of the front of the book and a surface of the pillow include the book title.

6. The combination defined in claim 1, wherein the pillow and the front of the book bear color combinations which are substantially the same, tending to suggest to a child that the book belongs with the pillow.

7. The combination defined in claim 1, wherein the pocket of the pillow is of such depth, and the book is of such height, that about one-fourth to two-fifths of the front of the book is exposed when the book is fully inserted in the pocket.

8. The combination defined in claim 7, wherein the book has a story title which is exposed when the book is fully inserted in the pocket.

9. The combination defined in claim 8, wherein the surface of the pillow opposite the side having the pocket bears a picture and a title representative of the content of the book.

10. A pillow and book combination for children, comprising: a pillow of appropriate size and shape for use by a child, having two opposed walls or surfaces and means securing the two walls to form a closed space, with cushioning material in the closed space between the walls, pocket means on the outside of one wall of the pillow, comprising a sheet of material secured to the one pillow wall so as to form with the pillow wall a pocket open at one side and of suitable size and shape for receipt of a children's book, a children's book received in the pocket and having a cover with marking serving to distinguish the book from other books the child may have.

the book and the pocket being so sized and configured that the book extends part way out of the pocket when fully inserted therein, exposing some of the distinguishing marking on the front of the book, and the pillow having on at least one of its outer surfaces some visual indicia substantially the same as the distinguishing marking on the book cover, sufficient to key the book to the pillow and to serve as a means for the child user of the book to identify the particular book with the particular pillow.

11. The pillow and book combination of claim 10, wherein the book cover marking and the pillow indicia include substantially the same colors for association together by the child.

* * * * *